US005533212A

United States Patent [19]

Moretz et al.

[11] Patent Number: 5,533,212

[45] **Date of Patent: * Jul. 9, 1996**

[54] COMBINATION MOISTURE MANAGEMENT PANTY AND PANTY HOSE SYSTEM FOR WOMEN

[75] Inventors: Herbert L. Moretz, Davidson, N.C.; Daniel L. Brier, Key Largo, Fla.

[73] Assignee: Intelpro Corporation, Lincolnton, N.C.

[ * ] Notice: The portion of the term of this patent subsequent to May 16, 2012, has been disclaimed.

[21] Appl. No.: 269,642

[22] Filed: Jun. 30, 1994

[51] Int. Cl.[6] ..... A41B 11/04; A41B 9/04

[52] U.S. Cl. ..... 2/409; 2/406

[58] Field of Search ..... 2/401–406, 409; 604/358, 378, 385, 393, 394, 396

[56] References Cited

U.S. PATENT DOCUMENTS

| | | | |
|---|---|---|---|
| 3,237,625 | 3/1966 | Johnson | 2/400 |
| 3,566,624 | 3/1971 | Burleson | 2/409 |
| 3,815,156 | 6/1974 | Gaither | 2/409 |
| 4,009,495 | 3/1977 | Faust | 2/406 |
| 4,067,068 | 1/1978 | Bregstein et al. | 2/406 |
| 4,412,433 | 11/1983 | Safrit et al. | 2/409 |
| 5,291,617 | 3/1994 | Moretz et al. | 2/400 |
| 5,390,376 | 2/1995 | Marx et al. | 2/406 |
| 5,392,467 | 2/1995 | Moretz et al. | 2/400 |
| 5,414,870 | 5/1995 | Moretz et al. | 2/403 |

*Primary Examiner*—John J. Calvert
*Assistant Examiner*—Gloria Hale
*Attorney, Agent, or Firm*—W. Thad Adams, III

[57] ABSTRACT

The invention is a combination moisture management panty and panty hose system for women. The moisture management system includes both a panty and panty hose. The panty includes a moisture management panty shield for being positioned in the crotch area of the wearer during garment wear. The panty shield has a first fabric layer with a skin side surface including moisture wicking fibers for residing next to the skin during garment wear. These such fibers wick moisture outwardly away from the skin towards drier areas of the garment for evaporation. The pair of panty hose is worn in combination with the panty, and includes a moisture management crotch gusset for being position adjacent to the panty shield in the crotch area of the wearer. The crotch gusset is constructed of an open mesh fabric for receiving moisture from the panty shield, and for facilitating the flow of air through the gusset into the panty shield. The open mesh fabric promotes moisture evaporation from the panty shield and the gusset.

12 Claims, 5 Drawing Sheets

COMBINATION MOISTURE MANAGEMENT PANTY AND PANTY HOSE SYSTEM FOR WOMEN

TECHNICAL FIELD AND BACKGROUND OF THE INVENTION

This invention relates to a combination moisture management panty and panty hose system for women. The invention includes both a panty and a pair of panty hose having complementary moisture management features for controlling wetness in the crotch area of the wearer. Although either garment may be worn separately, maximum moisture management will be enjoyed by wearing the garments in combination according to the moisture management system of the present invention.

The invention addresses a need expressed by many women for undergarments that help keep the crotch area dry. In a study conducted by DuPont Corporation, women in major cities in the USA were asked to rank fifteen characteristics of panties in terms of their importance, from "extremely important" to "not important at all." The characteristic ranked highest in importance by 88% of the women was proper fit. Significantly, however, the second highest ranked characteristic was keeping the crotch area dry, which was rated extremely important by 84% of the women. Keeping the body dry was third, rated extremely important by 78% of those surveyed.

Moisture is natural in the crotch area of women. It may arise from perspiration, normal body secretions, or minor urinary leakage or residue.

Increasingly, women are recognizing the importance of moisture management in their intimate apparel as a contributing factor to good health. Their concern is well placed. It is well known that warm, moist conditions on the skin are conducive to bacterial and fungal infections. Studies have shown that one-third to one-half of all women have suffered from yeast and/or other fungal infections in the vaginal area. In fact, it has been reported that the various topical ointments used to treat such infections are second only to aspirin in over the counter drug sales to women.

Along with these medications, physicians usually recommend that women wear loose fitting "breathable" clothing as an aid in preventing vaginal infections. They frequently recommend cotton panties as well, which is known by textile experts to be counterproductive, inasmuch as cotton holds moisture within its fibers next to the skin.

Despite the foregoing recommendations, many millions of women wear both panties and panty hose. It is reported that at least 75% to 85% of women wear both garments simultaneously. Almost invariably, the panties are worn next to the skin, and panty hose worn over the panties. The panty hose are typically nylon, as are the panties in many cases. Of course, nylon (at least as presently used in these garments) manages moisture very poorly. This combination creates an environment that is highly susceptible to infection.

Thus, there is a need for panties and panty hose that work together to manage moisture, rather than to exacerbate the moisture problem. The present invention provides modifications to both the panty and panty hose that create a moisture management system designed to keep the crotch area dry, thus helping to mitigate and prevent bacterial and fungal infections. To achieve the maximum benefit, it is desirable that the two garments be worn together as single system.

SUMMARY OF THE INVENTION

Therefore, it is an object of the invention to provide a moisture management system for women including a panty and panty hose having complementary moisture management features for controlling wetness in the crotch area of the wearer.

It is another object of the invention to provide a moisture management system for women which quickly wicks moisture away from the skin, and pulls the moisture upwardly and outwardly towards drier areas for dispersion and evaporation.

It is another object of the invention to provide a moisture management system for women which helps prevent the growth of yeast and/or other fungal infections in the vaginal area.

It is another object of the invention to provide a moisture management system for women which includes a panty and panty hose which may be worn separately for achieving a lesser degree of moisture management.

It is another object of the invention to provide a moisture management system for women which is not bulky in the crotch area of the wearer.

It is another object of the invention to provide a moisture management panty for women.

It is another object of the invention to provide a pair of moisture management panty hose for women.

It is another object of the invention to provide a pair of moisture management panty hose for women which includes a relatively large and breathable crotch gusset for enhancing air flow through the garment.

These and other objects of the present invention are achieved in the preferred embodiments disclosed below by providing a combination moisture management panty and panty hose system for women. The moisture management system includes both a panty and panty hose. The panty includes a moisture management panty shield for being positioned in the crotch area of the wearer during garment wear. The panty shield has a first fabric layer with a skin side surface including moisture wicking fibers for residing next to the skin during garment wear. These such fibers wick moisture outwardly away from the skin towards drier areas of the garment for evaporation.

The pair of panty hose is worn in combination with the panty, and includes a moisture management crotch gusset for being position adjacent to the panty shield in the crotch area of the wearer. The crotch gusset is constructed of an open mesh fabric for receiving moisture from the panty shield, and for facilitating the flow of air through the gusset into the panty shield. The open mesh fabric promotes moisture evaporation from the panty shield and the gusset.

According to one preferred embodiment of the invention, the moisture management panty shield includes a second fabric layer. The second fabric layer resides adjacent to the first fabric layer on a surface thereof opposite the skin side surface of the first fabric layer. The second fabric layer includes hydrophilic fibers for receiving moisture wicked outwardly by the first fabric layer to further move the moisture away from the skin of the wearer.

According to another preferred embodiment of the invention, the first and second fabric layers are integrally knit and plaited together to define a bi-component fabric. The bi-component fabric includes wicking fibers residing substantially on a skin side surface thereof, and hydrophilic fibers residing substantially on surface thereof opposite the skin side surface.

Preferably, the wicking fibers of the first fabric layer are hydrophobic fibers.

According to one preferred embodiment of the invention, the moisture management panty shield includes a third fabric layer. The third fabric layer is a moisture transport insert which resides adjacent to the second fabric layer. The moisture transport insert includes hydrophilic fibers for receiving moisture from the second fabric layer and for transporting the moisture upwardly away from the crotch area to drier areas of the panty shield for evaporation.

According to another preferred embodiment of the invention, the moisture transport insert is constructed of a bi-component, plaited fabric. The bi-component fabric includes wicking fibers residing substantially on a skin side surface thereof, and hydrophilic fibers residing substantially on the surface thereof opposite the skin side surface.

According to yet another preferred embodiment of the invention, the moisture transport insert is shaped in the form of an hourglass with the narrowest portion thereof for residing between the legs of the wearer.

According to yet another preferred embodiment of the invention, the moisture management panty shield includes a fourth fabric layer constructed of an open mesh fabric to facilitate the outward flow and dispersion of moisture away from the skin. The open mesh fabric permits air flow into the panty shield towards the skin to enhance moisture evaporation and breathability of the panty.

Preferably, the open mesh fabric of the fourth fabric layer includes hydrophilic fibers.

Preferably, the open mesh fabric of the moisture management crotch gusset includes hydrophilic fibers.

According to one preferred embodiment of the invention, the panty to be worn in combination with a moisture management panty and panty hose system for women includes a moisture management panty shield. The panty shield is positioned in the crotch area of the wearer during garment wear. The panty shield includes a first fabric layer and an outermost fabric layer. The first fabric layer has a skin side surface including moisture wicking fibers for residing next to the skin during garment wear. These fibers wick moisture outwardly away from the skin towards drier areas of the garment for evaporation. The outermost fabric layer is constructed of an open mesh fabric to facilitate the outward flow and dispersion of moisture away from the skin. The open mesh fabric permits air flow into the panty shield towards the first fabric layer and skin to enhance moisture evaporation and breathability of the panty.

According to one preferred embodiment of the invention, the moisture management panty shield includes a second fabric layer residing adjacent to the first fabric layer on a surface thereof opposite the skin side surface of the first fabric layer. The second fabric layer includes hydrophilic fibers for receiving moisture wicked outwardly by the first fabric layer to further move the moisture away from the skin of the wearer.

According to another preferred embodiment of the invention, the first and second fabric layers are integrally knit and plaited together to define a bi-component fabric. The bi-component fabric includes wicking fibers residing substantially on a skin side surface thereof, and hydrophilic fibers residing substantially on surface thereof opposite the skin side surface.

Preferably, the wicking fibers of the first fabric layer are hydrophobic fibers.

According to one preferred embodiment of the invention, the moisture management panty shield includes a third fabric layer including a moisture transport insert residing adjacent to the second fabric layer. The moisture transport insert includes hydrophilic fibers for receiving moisture from the second fabric layer and for transporting the moisture upwardly away from the crotch area to drier areas of the panty shield for evaporation.

According to another preferred embodiment of the invention, the moisture transport insert is constructed of an integrally knit bi-component fabric plaited with wicking fibers residing substantially on a skin side surface thereof, and hydrophilic fibers residing substantially on surface thereof opposite the skin side surface.

According to yet another preferred embodiment of the invention, the moisture transport insert is shaped in the form of an hourglass with the narrowest portion thereof for residing between the legs of the wearer.

Preferably, the open mesh fabric of the outermost fabric layer includes hydrophilic fibers.

According to one preferred embodiment of the invention, a pair of panty hose to be worn in combination with a moisture management panty and pantyhose system for women includes a moisture management crotch gusset. The gusset is positioned in the crotch area of the wearer during garment wear. The gusset is constructed of an open mesh fabric for receiving moisture from the skin of the wearer, and for facilitating the flow of air through the gusset to promote evaporation of moisture from the gusset.

Preferably, the open mesh fabric includes hydrophilic fibers.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
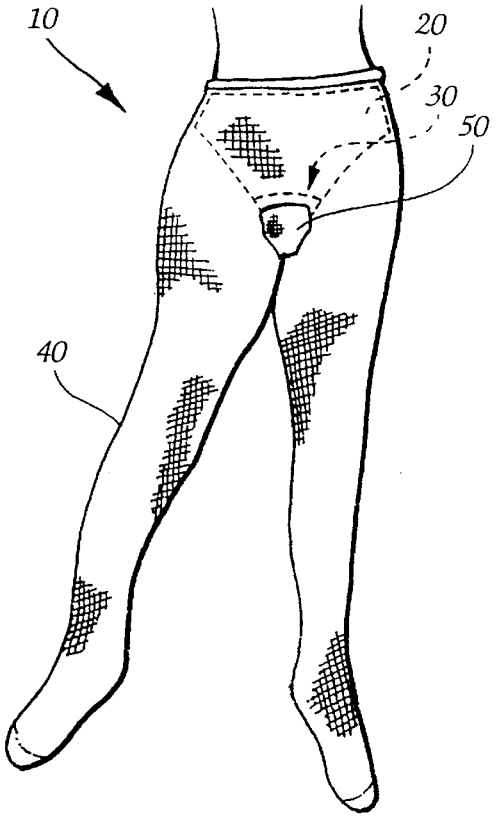
FIG. 1 is a perspective view of the panty and panty hose, during wear, according to a preferred embodiment of the moisture management system of the present invention.
Figure 2:
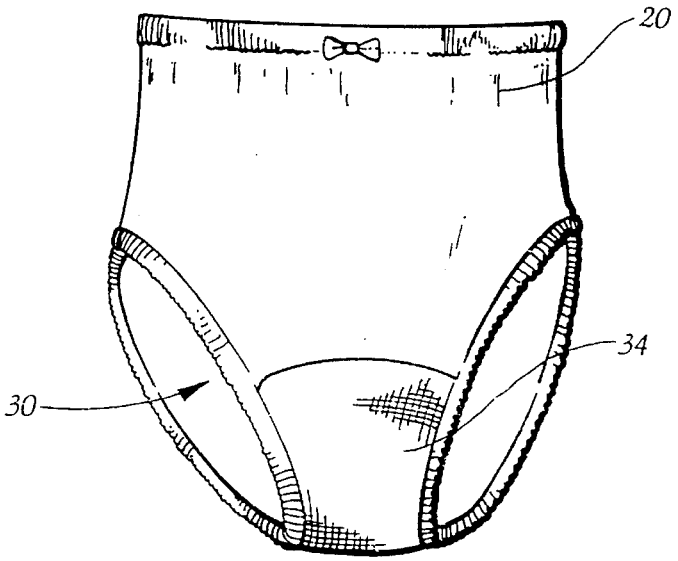
FIG. 2 is a front view of the panty for wear in the moisture management system illustrated in FIG. 1.

Referring now specifically to the drawings, a combination moisture management panty and panty hose system for women according to the present invention is illustrated in FIG. 1 and shown generally at reference numeral 10. The moisture management system 10 includes both a panty 20 and panty hose 40 intended to be worn in combination for achieving maximum moisture management efficiency. Preferably, the panty 20 is worn underneath the panty hose 40. Alternatively, the panty 20 and the panty hose 40 may be worn separately, while achieving a lesser degree of moisture management. The panty 20 and panty hose 40 are each described in detail below.

The Panty

Figure 3:
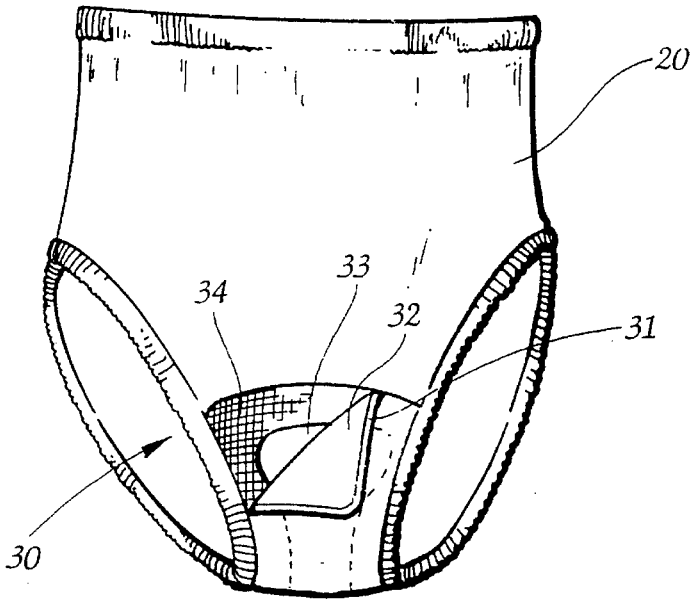
FIG. 3 is a front view of the panty turned inside out to show the moisture management panty shield, and with fabric layers peeled back to illustrate the composition of the panty shield according to a preferred embodiment.
Figure 4:
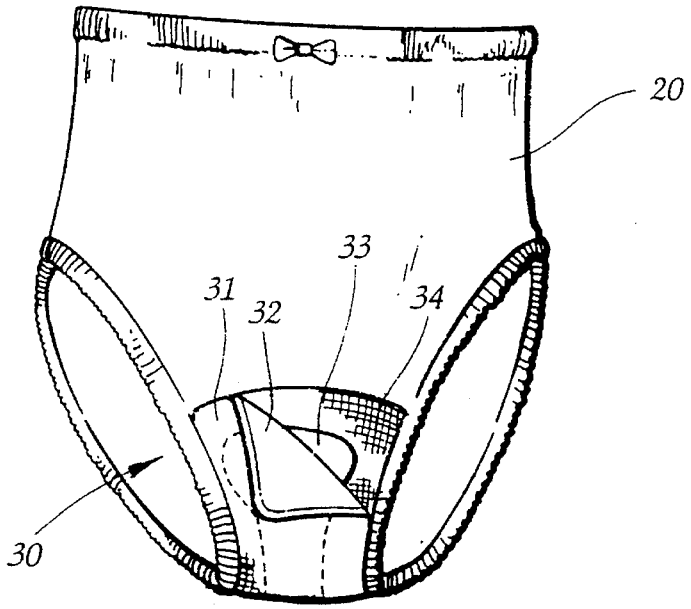
FIG. 4 is a back view of the panty turned inside out to show the moisture management panty shield, and with fabric layers peeled back to illustrate the composition of the panty shield according that shown in FIG. 3.

Referring to FIGS. 2–5, the panty 20 includes a multilayer, moisture management panty shield 30 for residing in the crotch area of the wearer during garment wear. The location of the panty shield 30 in the crotch area of the panty 20 is best shown in FIGS. 3 and 4.

Figure 5:
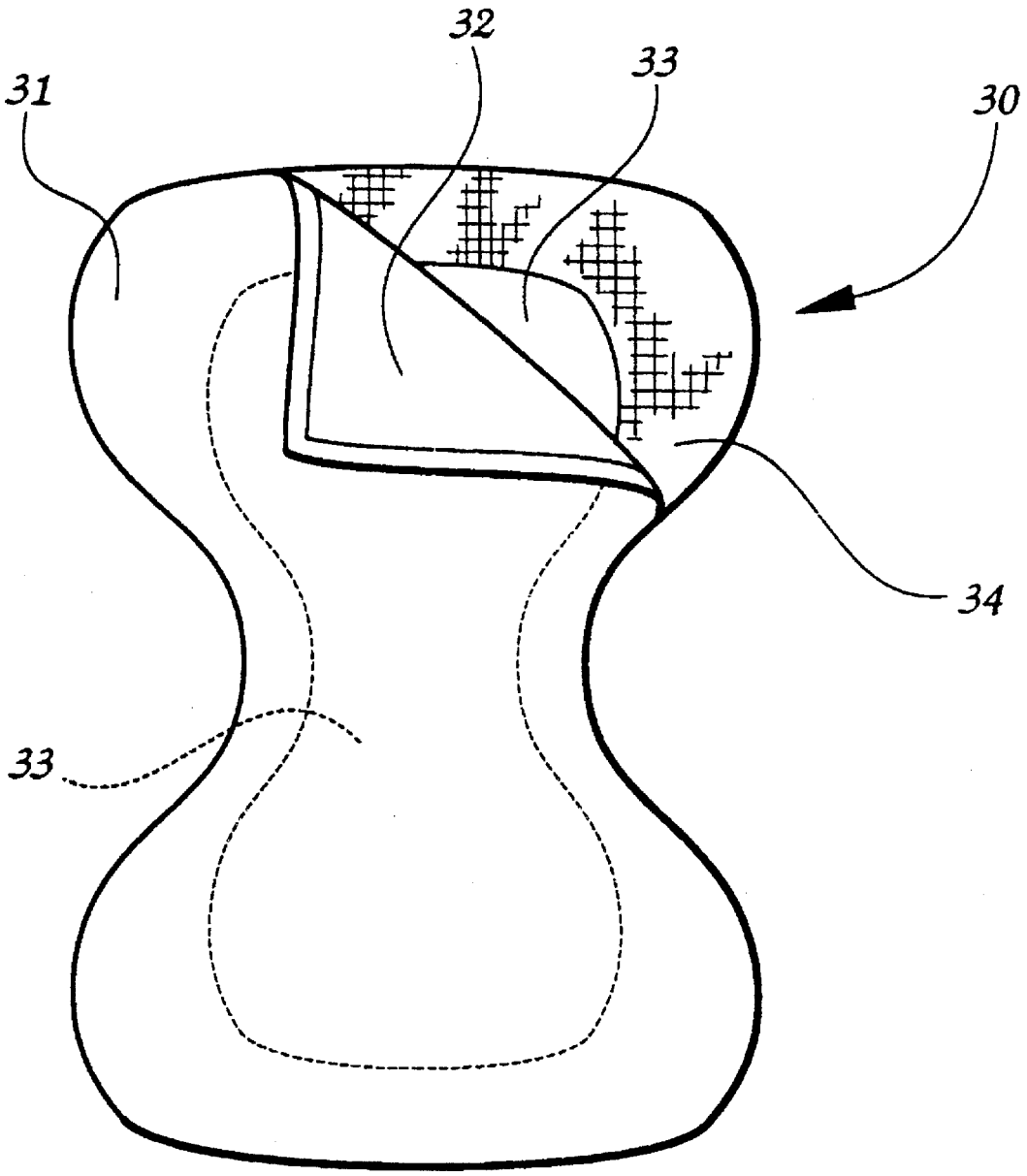
FIG. 5 is a plan view of the moisture management panty shield showing the first and second fabric layers peeled back.

As shown in FIGS. 3, 4, and 5, the panty shield 30 is constructed of a first fabric layer 31 for residing closest to the skin of the wearer, a second fabric layer 32 residing adjacent to the first layer 31, a third fabric layer comprising a moisture transport insert 33 residing adjacent to the second layer 32, and a fourth fabric layer 34 residing adjacent to the third layer. Preferably, the fourth layer 34 is the outermost fabric layer of the panty shield 30, and forms the shell fabric of the panty 20 in this area.

The first layer 31 of the panty shield 30 has a skin side surface including moisture wicking fibers for residing closest to the skin, and for wicking moisture outwardly away from the skin towards drier areas of the garment for evaporation. The moisture wicking fibers are preferably hydrophobic fibers, such as polyester or polypropylene. According to one embodiment, the moisture wicking fibers are specially channeled polyester fibers, such as "Coolmax" fibers produced by DuPont Corporation.

The second fabric layer 32 is formed of hydrophilic fibers designed to receive moisture wicked outwardly away from the skin by the first fabric layer 31, and to pull the moisture away from the first fabric layer 31 towards the outer layers of the panty shield 30 for dispersion and evaporation. Preferably, the hydrophilic fibers are hydrophilic nylon fibers produced by Allied Signal Fibers, and sold under the trademark "Hydrofil". Alternately, the hydrophilic fibers may be Intera-treated nylon fibers processed by the Intera Corporation of Cleveland, Tenn.

According to an alternative embodiment, the second fabric layer 32 is formed of hydrophilic fibers integrally knit in a plaited relationship with the first fabric layer 31. The plaited nature of the first and second fabric layers 31 and 32 forms a integral, bi-component fabric with the hydrophobic fibers of the first fabric layer 31 residing primarily on the skin side surface of the fabric and the hydrophilic fibers of the second fabric layer 32 residing primarily on the surface opposite the skin side surface. For example, the skin side surface may be 70%–90% hydrophobic and 10%–30% hydrophilic, while the surface opposite the skin side surface may be 70%–90% hydrophilic and 10%–30% hydrophobic.

The third fabric layer is a moisture transport insert 33. The moisture transport insert 33 resides adjacent to the second fabric layer 32, and is preferably hourglass-shaped with the narrowest portion of the insert 33 being positioned between the legs of the wearer during garment wear. Preferably, the width of the narrowest portion is approximately 1–2 inches (2–5 cm), while the width of the wider end portions are approximately 4–6 inches (10–15 cm). The moisture transport insert 33 operates to receive moisture from the second fabric layer 32, and to transport the moisture outwardly and upwardly towards wider and drier areas of the panty shield 30 for dispersion and quick evaporation.

According to one embodiment, the moisture transport insert 33 is formed entirely of hydrophilic fibers, such as "Hydrofil" nylon, Intera-treated polyester or nylon, rayon, cotton, wool, or blends of these fibers. Alternatively, the moisture transport insert 33 may be constructed of a bi-component fabric including hydrophobic and hydrophilic fibers which are integrally knit and plaited together. The hydrophobic wicking fibers reside primarily on a surface of the fabric closest to the skin, while the hydrophilic fibers reside primarily on a surface opposite the surface closest to the skin. For example, the fabric surface closest to the skin may be 70%–90% hydrophobic and 10%–30% hydrophilic, and the fabric surface opposite the surface closest to the skin may be 70%–90% hydrophilic and 10%–30% hydrophobic.

The fourth fabric layer 34 is constructed of an open mesh hydrophilic fabric which preferably forms the outermost fabric layer of the moisture management panty shield 30. Preferably, the open mesh fabric has approximately 25–50 openings per square inch to facilitate the flow of air inwardly through the panty shield 30 towards the skin. This enhances the "breathability" of the panty shield 30, and decreases moisture evaporation time. The hydrophilic fibers of the open mesh fabric may be hydrophilic nylon, Intera-treated polyester or nylon, rayon, cotton, wool, or blends of the fibers.

Except for the moisture management panty shield 30 described above, the panty 20 is constructed in a conventional manner using conventional fabrics well known in the art. The various layers of the panty shield 30 are connected to each other and to the crotch area of the panty 20 using standard cut-and-sew techniques. In addition, one or more of the layers of the panty shield 30 may be omitted from the panty 20 for achieving less bulk in the crotch area of the garment.

The Panty Hose

Figure 6:
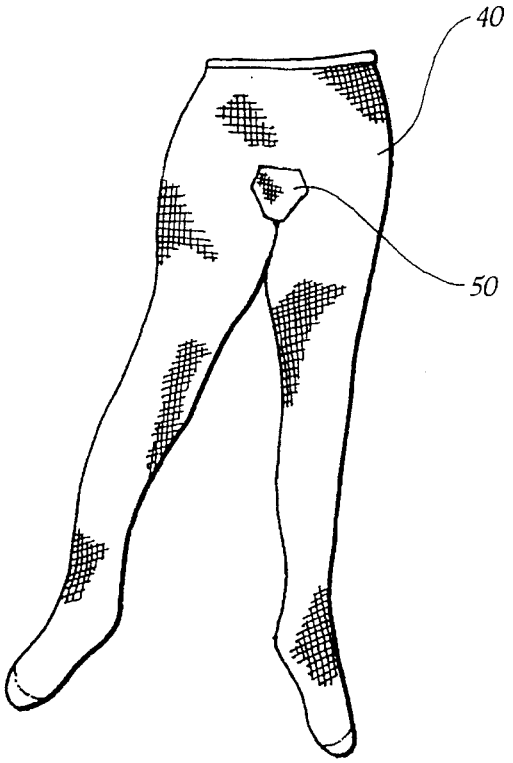
FIG. 6 is a front view of the panty hose for wear in the moisture management system according to a preferred embodiment of the invention.
Figure 7:
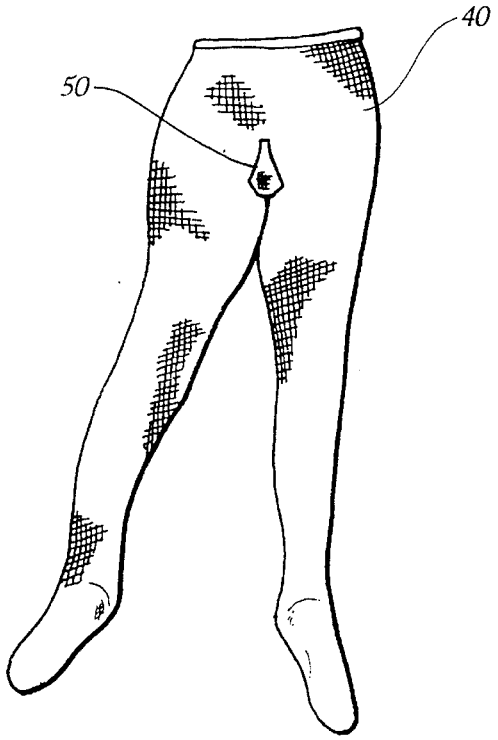
FIG. 7 is a back view of the panty hose according to the embodiment shown in FIG. 6.
Figure 8:
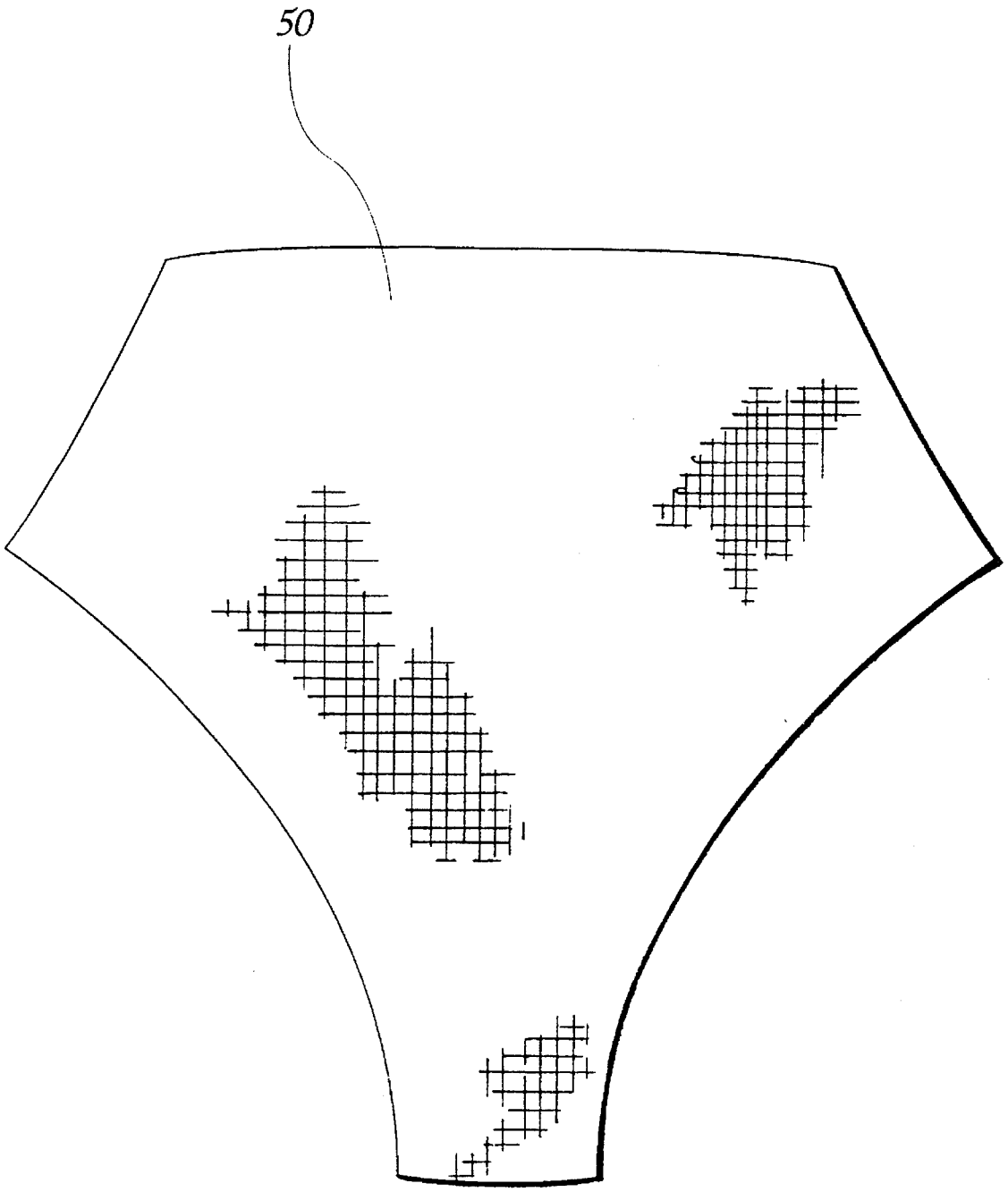
FIG. 8 is a plan view of the moisture management crotch gusset of the panty hose according to a preferred embodiment of the invention.

As best shown in FIGS. 6–8, the panty hose 40 includes a moisture management crotch gusset 50 positioned in the crotch area of the panty hose 40 for residing adjacent to the moisture management panty shield 30 of the panty 20 (See FIG. 1). The crotch gusset 50 is preferably sewn into the crotch area of the panty hose 40 using standard cut-and-sew techniques.

The location of the crotch gusset 50 is best illustrated in FIGS. 6 and 7. Preferably, the gusset 50 is shaped to completely overlie the moisture management panty shield 30 of the panty 20. The shape of the gusset 50 may be triangular, diamond, rectangular, oval, hourglass or other suitable shapes.

The gusset 50 is constructed of an open mesh hydrophilic fabric designed to receive and disperse moisture wicked outwardly by the moisture management panty shield 30 of the panty 20. The hydrophilic fibers of the open mesh fabric may be hydrophilic nylon, Intera-treated polyester or nylon, rayon, cotton, wool, or blends of these fibers. Preferably, the open mesh fabric includes approximately 25–50 openings per square inch. This open mesh construction facilitates the flow of air through the gusset 50 and into the panty shield 30 of the panty 20, thus maximizing the breathability, moisture transfer, and evaporation of the moisture management panty and panty hose system 10.

Except for the moisture management crotch gusset 50 described above, the pair of panty hose 40 is constructed in a conventional manner using conventional fabrics well known in the art.

A combination moisture management panty and panty hose system for women is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

We claim:

1. A combination moisture management panty and panty hose system for women, comprising:

(a) a panty including a moisture management panty shield for being positioned in the crotch area of the wearer during garment wear, said moisture management panty shield comprising:

i. a first fabric layer having a skin side surface including moisture wicking fibers for residing next to the skin during garment wear, and for wicking moisture outwardly away from the skin towards drier areas of the garment for evaporation;

ii. a second fabric layer residing adjacent to said first fabric layer on a surface thereof opposite the skin side surface of said first fabric layer, said second fabric layer including hydrophilic fibers for receiving moisture wicked outwardly by said first fabric layer to further move moisture away from the skin of the wearer;

iii. a third fabric layer comprising a moisture transport insert residing adjacent to the second fabric layer, and constructed of an integrally knit plaited bi-component fabric with wicking fibers residing primarily on a skin side surface thereof, and hydrophilic fibers residing primarily on a surface thereof opposite the skin side surface; and (b) a pair of panty hose to be worn in combination with said panty, and including a moisture management crotch gusset for being position adjacent to said panty shield in the crotch area of the wearer, said crotch gusset constructed of an open mesh fabric for receiving moisture from said panty shield, and for facilitating the flow of air through said gusset into said panty shield to promote moisture evaporation from said panty shield and said gusset.

2. A combination panty and panty hose system according to claim 1, wherein said first and second fabric layers are integrally knit and plaited together to define a bi-component fabric with wicking fibers residing primarily on a skin side surface thereof, and hydrophilic fibers residing primarily on a surface thereof opposite the skin side surface.

3. A combination panty and panty hose system according to claim 1, wherein the wicking fibers of said first fabric layer are hydrophobic fibers.

4. A combination panty and panty hose system according to claim 1, wherein said moisture transport insert is shaped in the form of an hourglass with the narrowest portion thereof for residing between the legs of the wearer.

5. A combination panty and panty hose system according to claim 1, wherein said moisture management panty shield includes a fourth fabric layer constructed of an open mesh fabric to facilitate the outward flow and dispersion of moisture away from the skin, the open mesh fabric permitting air flow into the panty shield towards the skin to enhance moisture evaporation and breathability of the panty.

6. A combination panty and panty hose system according to claim 5, wherein the open mesh fabric of said fourth fabric layer includes hydrophilic fibers.

7. A combination panty and panty hose system according to claim 1, wherein the open mesh fabric of the moisture management crotch gusset includes hydrophilic fibers.

8. A panty to be worn in combination with a pair of moisture management panty hose, said panty comprising a moisture management panty shield for being positioned in the crotch area of the wearer during garment wear, said moisture management panty shield comprising:

(a) a first fabric layer having a skin side surface including moisture wicking fibers for residing next to the skin during garment wear, and for wicking moisture outwardly away from the skin towards drier areas of the garment for evaporation;

(b) a second fabric layer residing adjacent to said first fabric layer on a surface thereof opposite the skin side surface of said first fabric layer, said second fabric layer including hydrophilic fibers for receiving moisture wicked outwardly by said first fabric layer to further move moisture away from the skin of the wearer;

(c) a third fabric layer comprising a moisture transport insert residing adjacent to the second fabric layer, and constructed of an integrally knit plaited bi-component fabric with wicking fibers residing primarily on a skin side surface thereof, and hydrophilic fibers residing primarily on a surface thereof opposite the skin side surface; and (d) an outermost panty fabric layer constructed of an open mesh fabric to facilitate the outward flow and dispersion of moisture away from the skin, the open mesh fabric permitting air flow into the panty shield towards the first fabric layer and skin to enhance moisture evaporation and breathability of the panty.

9. A panty according to claim 8, wherein said first and second fabric layers are integrally knit and plaited together to define a bi-component fabric with wicking fibers residing primarily on a skin side surface thereof, and hydrophilic fibers residing primarily on surface thereof opposite the skin side surface.

10. A panty according to claim 8, wherein the wicking fibers of said first fabric layer are hydrophobic fibers.

11. A panty according to claim 8, wherein said moisture transport insert is shaped in the form of an hourglass with the narrowest portion thereof for residing between the legs of the wearer.

12. A panty according to claim 8, wherein the open mesh fabric of the outermost fabric layer includes hydrophilic fibers.

* * * * *